US005408830A

United States Patent [19]

Lovett

[11] Patent Number: 5,408,830

[45] Date of Patent: Apr. 25, 1995

[54] MULTI-STAGE FUEL NOZZLE FOR REDUCING COMBUSTION INSTABILITIES IN LOW NOX GAS TURBINES

[75] Inventor: Jeffery A. Lovett, Scotia, N.Y.

[73] Assignee: General Electric Company, Schenectady, N.Y.

[21] Appl. No.: 194,554

[22] Filed: Feb. 10, 1994

[51] Int. Cl.[6] ..... F23R 3/36; F02C 7/22

[52] U.S. Cl. ..... 60/737; 60/742; 239/422; 239/601

[58] Field of Search ..... 60/737, 748, 740, 742, 60/743, 39.463; 239/422, 549, 556, 601

[56] References Cited

U.S. PATENT DOCUMENTS

| | | | |
|---|---|---|---|
| 1,494,020 | 5/1924 | Riehm | 239/549 |
| 4,311,277 | 1/1982 | Stratton | 239/403 |
| 4,373,325 | 2/1983 | Shekleton | 60/737 |
| 4,589,260 | 5/1986 | Krockow | 60/748 |
| 4,833,878 | 5/1989 | Sood et al. | 60/39.163 |
| 4,850,194 | 7/1989 | Füglistaller et al. | 60/748 |
| 4,982,570 | 1/1991 | Waslo et al. | 60/733 |
| 5,193,346 | 3/1933 | Kuwata et al. | 60/737 |
| 5,199,265 | 4/1993 | Borkowicz | 60/737 |
| 5,218,824 | 6/1993 | Cederwall et al. | 60/737 |
| 5,259,184 | 11/1993 | Borkowicz et al. | 60/39.55 |

OTHER PUBLICATIONS

Keith R. McManus, "The Effects of Controlling Vortex Formation on the Performance of a Dump Combustor," High Temperature Gasdynamics Laboratory Report T-262, Stanford University, Jun. 1990, pp. 16–18 and 178–185.

*Primary Examiner*—Timothy S. Thorpe
*Attorney, Agent, or Firm*—Patrick R. Scanlon; Paul R. Webb, II

[57] ABSTRACT

A fuel nozzle for gas turbine combustors reduces combustion instabilities by injecting purge air into the combustor angularly instead of axially. The fuel nozzle has a substantially cylindrical body with a number of internal passages. One of the passages provides premix gas fuel to a plurality of fuel injectors attached to the fuel nozzle. The remaining passages can be for diffusion gas, atomizing air and liquid fuel. One or more of the remaining passages is connected to a respective group of discharge orifices formed in the cylindrical side surface of the nozzle body. During low $NO_x$ operation, premix gas is introduced through the fuel injectors, and the remaining passages are all purged with air to prevent the ingress of flame gases from the combustion chamber. The resulting jets of air emitted from discharge orifices formed in the side surface will disrupt or break-up spanwise vortices shed from the bluff end of the fuel nozzle, thereby reducing combustion instabilities. These air jets are preferably discharged at an angle of about 45 degrees to the longitudinal axis of the fuel nozzle. The orifices can be rectangular, circular or triangular in shape.

19 Claims, 3 Drawing Sheets

MULTI-STAGE FUEL NOZZLE FOR REDUCING COMBUSTION INSTABILITIES IN LOW NOX GAS TURBINES

BACKGROUND OF THE INVENTION

This invention relates generally to gas turbine combustors and more particularly to improvements in gas turbine combustors for reducing combustion-induced instabilities.

In power plant design, reducing emissions of harmful gases such as $NO_x$ into the atmosphere is of prime concern. Low $NO_x$ combustors employing lean premixed combustion are being developed to address this problem. One such combustor comprises a plurality of burners attached to a single combustion chamber. Each burner includes a flow tube with a centrally-disposed fuel nozzle comprising a cylindrical hub which supports fuel injectors and an air swirler and has a flat face on its downstream end. In addition to a premix-injection stage for low $NO_x$ operation, each fuel nozzle can include a diffusion-injection stage for start-up and emergency operations and a liquid fuel-injection stage for liquid fuel operation. Diffusion gas fuel and liquid fuel are typically injected via orifices located on the flat end face of the fuel nozzle.

During low $NO_x$ (premix) operation, fuel is injected through the fuel injectors and mixes with the swirling air in the flow tube. The diffusion and liquid fuel circuits are typically purged with air during premix operation to keep flame gases out of the passages. The combustion flame is stabilized by bluff-body recirculation behind the fuel nozzle and swirl breakdown, if swirl is present. With premixed systems, strong pressure oscillations are typically produced as a result of combustion instabilities. The combustion instabilities are believed to be related to the shedding of spanwise vortices from the bluff end of the fuel nozzle.

These pressure oscillations can severely limit the operation of the device and in some cases can even cause physical damage to combustor hardware. Furthermore, the flow of purge air through the diffusion and liquid fuel circuits is injected directly into the recirculation zone. This direct injection reduces the local temperature and strength of the recirculation, producing an adverse effect on flame stability.

Accordingly, there is a need for a low $NO_x$ combustor which reduces pressure oscillations and avoids the adverse effects of injecting purge air directly into the recirculation zone.

SUMMARY OF THE INVENTION

The above-mentioned needs are met by the present invention which provides an improved fuel nozzle assembly for gas turbine combustors. The fuel nozzle assembly comprises a substantially cylindrical body having a premix gas passage and a diffusion gas passage formed therein. A plurality of fuel injectors extend radially outward from the cylindrical surface of the body, each one of the fuel injectors having at least one injection port in fluid communication with the premix gas passage. A plurality of discharge orifices are formed in the cylindrical surface of the body in fluid communication with the diffusion gas passage. The body comprises a plurality of concentric tubes and a discharge tip disposed at the forward end of the tubes. The premix gas and diffusion gas passages are formed between adjacent ones of the tubes and the discharge orifices are formed in the discharge tip. The orifices, which are located downstream from the fuel injectors, can be rectangular, circular or triangular in shape. The discharge orifices are fluidly connected to the diffusion gas passage by a plurality of channels formed in the discharge tip. Each one of the channels defines an angle, preferably approximately 45 degrees, with the longitudinal axis of the body.

In addition to premix gas and diffusion gas passages, the fuel nozzle assembly can include a liquid fuel passage and an atomizing air passage. These additional passages can be arranged to discharge either axially from the bluff end of the fuel nozzle assembly, as is done conventionally, or from the cylindrical surface. In the latter case, a second plurality of discharge orifices is formed in the cylindrical surface of the body in fluid communication with the liquid fuel passage, and a third plurality of discharge orifices is formed in the cylindrical surface of the body in fluid communication with the atomizing air passage.

During low $NO_x$ operation, premix gas is introduced through the fuel injectors. The diffusion gas, liquid fuel and atomizing air passages are all purged with a flow of air to prevent the ingress of flame gases from the combustion chamber. Because at least some of the discharge orifices are formed in the cylindrical surface of the fuel nozzle body, purge air is angularly injected into the combustion chamber in a direction across the primary flow into the combustion chamber. This purge air will thus disrupt or break-up spanwise vortices shed from the bluff end of the fuel nozzle assembly, thereby reducing combustion instabilities and pressure oscillations.

Thus, by using angular injection of purge air, the present invention is able to extend the operating range of gas turbine combustors and reduce physical damage. The adverse effect of purge air on the recirculation zone temperature and flame stability will also be reduced because purge air is not injected straight into the recirculation zone. An additional benefit is that the angular injection will increase the size of the recirculation zone and thus improve flame stability. Furthermore, because they are located on the side and not the bluff end of the fuel nozzle assembly, the discharge orifices will be less prone to ingesting flames from the combustion chamber. When operating in the diffusion and/or liquid fuel modes, the angular injection will produce enhanced fuel mixing. The improved mixing will decrease $NO_x$ emissions and increase ignition performance.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
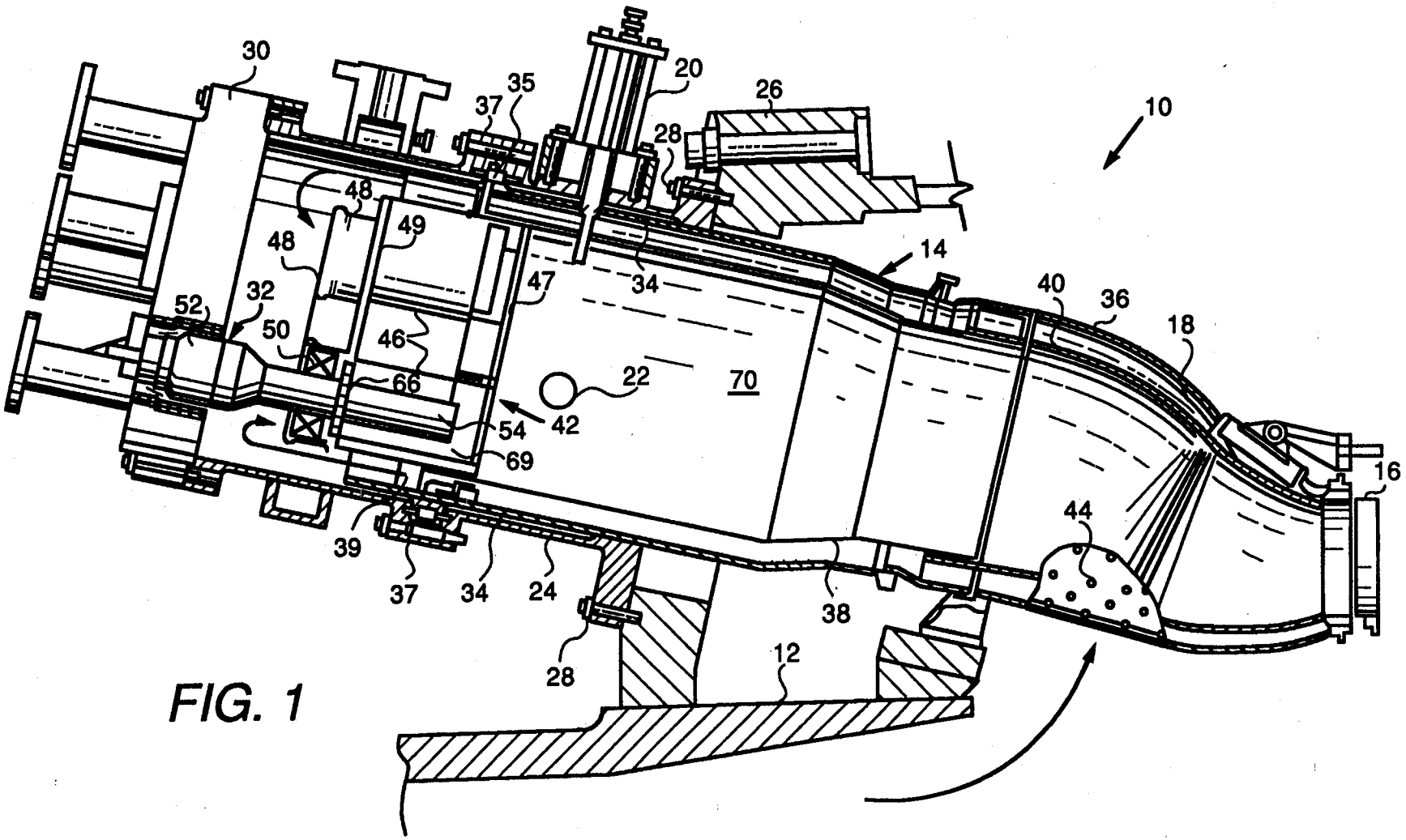
FIG. 1 is a partial cross-section through one combustor of a gas turbine in accordance with the present invention.

Referring to the drawings wherein identical reference numerals denote the same elements throughout the various views, FIG. 1 shows a gas turbine 10 which includes a compressor 12 (partially shown), a plurality of combustors 14 (one shown for convenience and clarity), and a turbine 16 represented in the Figure by a single blade. Although not specifically shown, the turbine 16 is drivingly connected to the compressor 12 along a common axis. The compressor 12 pressurizes inlet air which is then reverse flowed to the combustor 14 where it is used to cool the combustor and to provide air to the combustion process. Although only one combustor 14 is shown, the gas turbine 10 includes a plurality of combustors 14 located about the periphery thereof. A double-walled transition duct 18 connects the outlet end of each combustor 14 with the inlet end of the turbine 16 to deliver the hot products of combustion to the turbine 16.

Each combustor 14 includes a substantially cylindrical combustion casing 24 which is secured at an open forward end to a turbine casing 26 by means of bolts 28. The rearward end of the combustion casing 24 is closed by an end cover assembly 30 which may include conventional supply tubes, manifolds and associated valves, etc. for feeding gas, liquid fuel and air (and water if desired) to the combustor 14. The end cover assembly 30 receives a plurality (for example, five) of fuel nozzle assemblies 32 (only one shown for purposes of convenience and clarity) arranged in a circular array about a longitudinal axis of the combustor 14. Each fuel nozzle assembly 32 is a substantially cylindrical body having a rearward supply section 52 having inlets for receiving gas fuel, liquid fuel and air (and water if desired) and a forward delivery section 54.

Within the combustion casing 24, there is mounted, in substantially concentric relation thereto, a substantially cylindrical flow sleeve 34 which connects at its forward end to the outer wall 36 of the double walled transition duct 18. The flow sleeve 34 is connected at its rearward end by means of a radial flange 35 to the combustion casing 24 at a butt joint 37 where fore and aft sections of the combustor casing 24 are joined.

Within the flow sleeve 34, there is a concentrically arranged combustion liner 38 which is connected at its forward end with the inner wall 40 of the transition duct 18. The rearward end of the combustion liner 38 is supported by a combustion liner cap assembly 42 which is, in turn, supported within the combustion casing 24 by a plurality of struts 39. It will be appreciated that the outer wall 36 of the transition duct 18, as well as that portion of flow sleeve 34 extending forward of the location where the combustion casing 24 is bolted to the turbine casing 26 (by bolts 28) are formed with an array of apertures 44 over their respective peripheral surfaces to permit air to reverse flow from the compressor 12 through the apertures 44 into the annular space between the flow sleeve 34 and the liner 38 toward the upstream or rearward end of the combustor 14 (as indicated by the flow arrows shown in FIG. 1).

The combustion liner cap assembly 42 supports a plurality of premix tubes 46, one for each fuel nozzle assembly 32. More specifically, each premix tube 46 is supported within the combustion liner cap assembly 42 at its forward and rearward ends by front and rear plates 47, 49, respectively, each provided with openings aligned with the open-ended premix tubes 46. The premix tubes 46 are supported so that the forward delivery sections 54 of the respective fuel nozzle assemblies 32 are disposed concentrically therein.

The rear plate 49 mounts a plurality of rearwardly extending floating collars 48 (one for each premix tube 46, arranged in substantial alignment with the openings in the rear plate 49. Each floating collar 48 supports an annular air swirler 50 in surrounding relation to the respective fuel nozzle assembly 32. Radial fuel injectors 66 are provided downstream of the swirler 50 for discharging gas fuel into a premixing zone 69 located within the premix tube 46. The arrangement is such that air flowing in the annular space between the liner 38 and the flow sleeve 34 is forced to again reverse direction in the rearward end of the combustor 14 (between the end cap assembly 30 and sleeve cap assembly 42) and to flow through the swirlers 50 and premix tubes 46 before entering the burning zone or combustion chamber 70 within the liner 38, downstream of the premix tubes 46. Ignition is achieved in the multiple combustors 14 by means of a spark plug 20 in conjunction with cross fire tubes 22 (one shown) in the usual manner.

Figure 2:
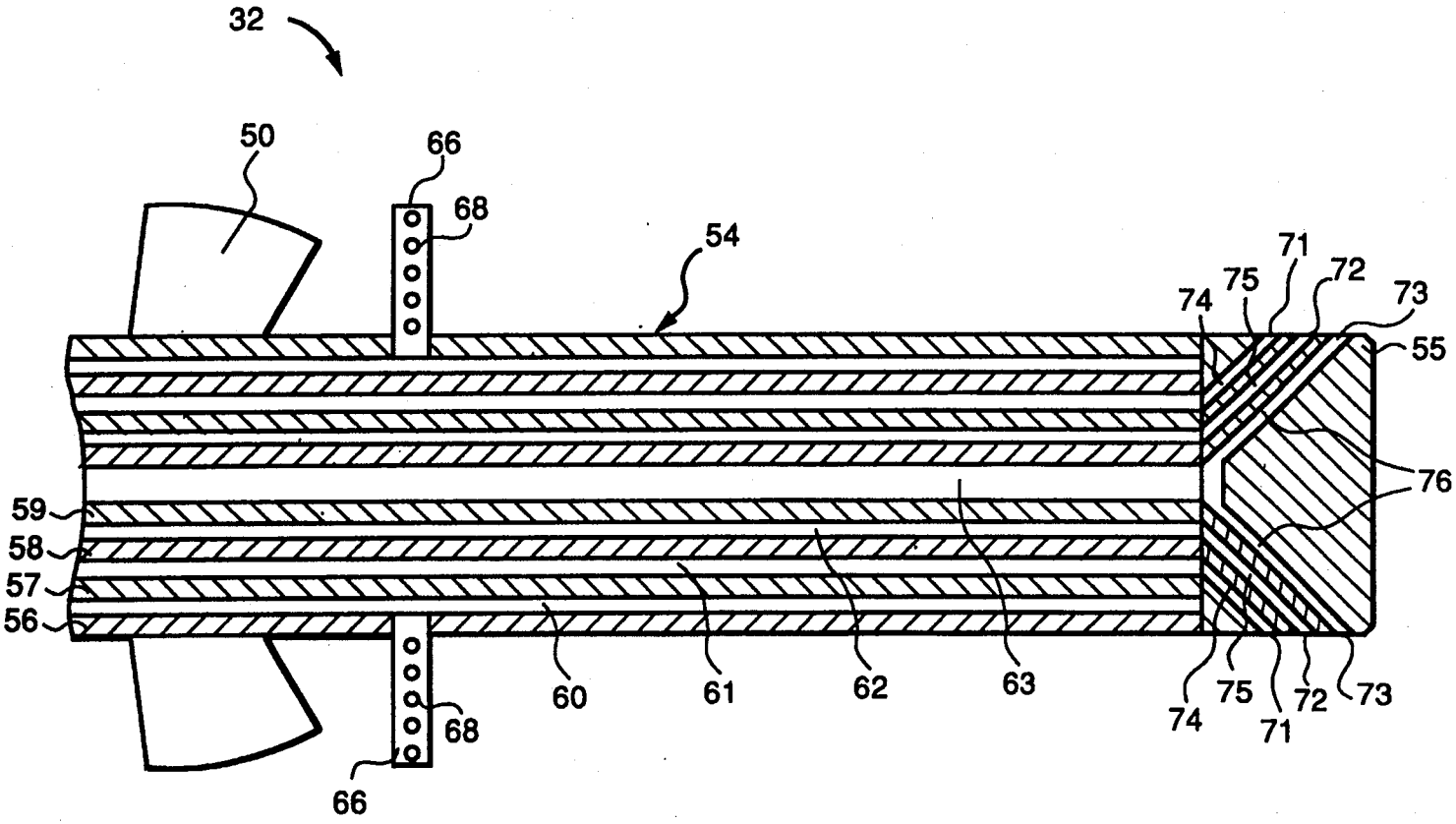
FIG. 2 is a cross-sectional view of a fuel nozzle assembly of the present invention.

Turning now to FIG. 2, one embodiment of the fuel nozzle assembly 32 of the present invention is schematically shown in cross-section. Although the fuel nozzle assembly 32 has been described as being implemented in the gas turbine 10, this is only for purposes of illustration. The fuel nozzle assembly 32 is equally applicable to other gas turbine designs.

The forward delivery section 54 is comprised of four concentric tubes 56–59 and a discharge tip 55 disposed at the forward or downstream end of the concentric tubes. The tubes are radially spaced so that adjacent ones define annular passages therebetween. The first and second concentric tubes 56, 57 (i.e., the two radially outermost concentric tubes) define a premix gas passage 60 therebetween which receives premix gas fuel from the rearward supply section 52. The premix gas passage 60 communicates with a plurality of radial fuel injectors 66, each of which is provided with a plurality of fuel injection ports or holes 68 for discharging gas fuel into the premix zone 69 located within the premix tube 46. The injected fuel mixes with air reverse flowed from the compressor 12, and swirled by means of the annular swirler 50 surrounding the fuel nozzle assembly 32 upstream of the radial injectors 66.

The second and third concentric tubes 57, 58 define a diffusion gas passage 61 therebetween, and the third and fourth concentric tubes 58, 59 define an atomizing air passage 62 therebetween. The fourth tube 59, the innermost of the concentric tubes, forms a central, liquid fuel passage 63 therein. In addition to providing gas fuel to the premix gas passage 60, the rearward supply section 52 also provides gas fuel to the diffusion gas passage 61, air to the atomizing air passage 62, and liquid fuel to the liquid fuel passage 63. The rearward supply section 52 operates in a manner well known in the art. For example, a suitable rearward supply section is described in U.S. Pat. No. 5,259,184 issued Nov. 9, 1993 to Richard Borkowicz et al, herein incorporated by reference. When not in use for injecting fuel (i.e., during premix mode operation), the passages 61, 63 are purged with a flow of air to prevent the ingress of flame gases from the combustion chamber 70.

The fuel nozzle assembly 32 can optionally be provided with a further passage (not shown) for supplying water to the combustion chamber 70 to effect $NO_x$ reductions in a manner understood by those skilled in the art. If such an optional water passage was used, then an additional concentric tube would be included so that the water passage would be located radially inward of the atomizing air passage 62. It will be understood by those skilled in the art that water injection is intended to be used sparingly in the present invention because the primary, lean premix mode of operation is the preferred manner of reducing $NO_x$ emissions.

The cylindrical side surface of the discharge tip 55 is provided with three sets of discharge orifices 71–73 corresponding to the passages 61–63, respectively. Each of the three sets comprises a plurality of orifices disposed about the periphery of the discharge tip 55, downstream of the radial fuel injectors 66 near the bluff end of the fuel nozzle assembly 32. A plurality of internal channels 74–76 are provided in the discharge tip 55 for fluidly connecting the discharge orifices 71–73 to their corresponding passages. Specifically, each one of the first set of orifices 71 is connected to the diffusion gas passage 61 by a channel 74, each one of the second set of orifices 72 is connected to the atomizing air passage 62 by a channel 75, and each one of the third set of orifices 73 is connected to the liquid fuel passage 63 by a channel 76.

Because the orifices 71–73 are formed in the outer cylindrical surface of the discharge tip 55 instead of on the back face as is done conventionally, any discharge from the orifices 71–73 is injected into the combustion chamber 70 in a direction across the primary flow into the combustion chamber 70 instead of along the flow. The channels 74–76 are disposed at an angle to the longitudinal axis of the fuel nozzle assembly 32 to produce a suitable angle of injection. The angle formed between the channels 74–76 and the longitudinal axis of the fuel nozzle assembly 32 can be up to 90°, although an angle of approximately 45° is believed to be optimal. In addition to forming an angle with the longitudinal axis in a radial direction (as shown in FIG. 2), the channels 74–76 can be also angled in a circumferential direction to produce swirl with or against the swirl of the air flowing through the premix tube 46.

As described above, each one of the passages 61–63 is arranged for angular discharge. However, this is not necessary to achieve reduction of combustion instabilities. Alternatively, the atomizing air passage 62 or both the atomizing air passage 62 and the liquid fuel passage 63 can be constructed to discharge substantially axially from the bluff end of the fuel nozzle assembly 32, as is conventionally done. Such substantially axial discharge is described in the above-mentioned U.S. Pat. No. 5,259,184 which is incorporated by reference. The diffusion gas passage 61 will still be arranged for angular injection, in the manner described above.

Figure 3:
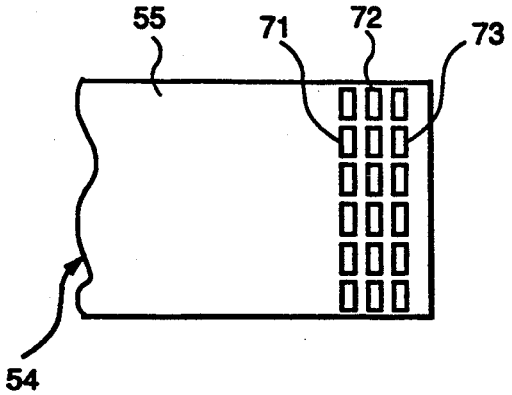
FIG. 3 shows a first embodiment of the forward end of the fuel nozzle assembly of FIG. 2.
Figure 4:
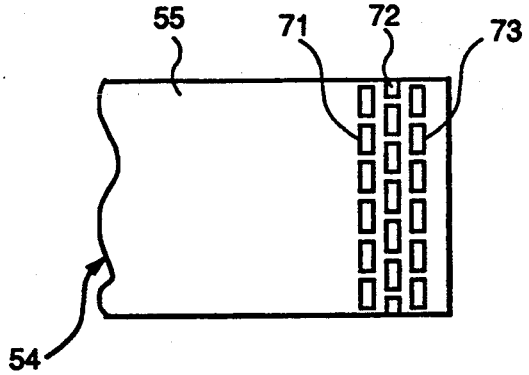
FIG. 4 shows a second embodiment of the forward end of the fuel nozzle assembly of FIG. 2.
Figure 5:
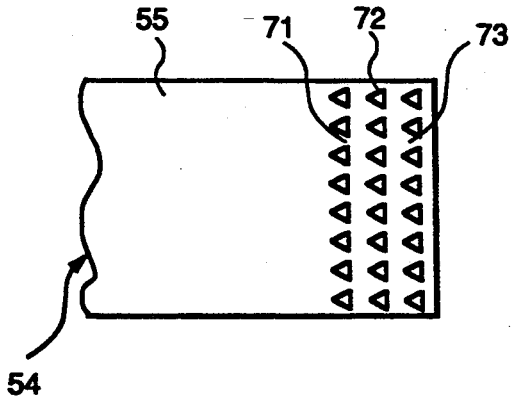
FIG. 5 shows a third embodiment of the forward end of the fuel nozzle assembly of FIG. 2.
Figure 6:
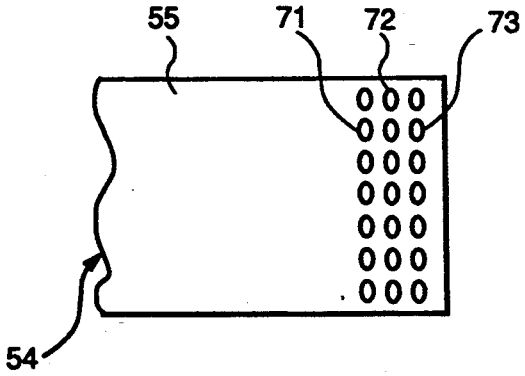
FIG. 6 shows a fourth embodiment of the forward end of the fuel nozzle assembly of FIG. 2.

As shown in FIGS. 3–6, the discharge orifices 71–73 of each set are equally spaced about the circumference of the discharge tip 55. The circumferential spacing between adjacent orifices is preferably, but not necessarily, on the order of the boundary layer thickness for typical operating conditions. The orifices 71–73 of the three sets can be axially aligned as shown in FIG. 3, or the orifices 71–73 can be staggered from set-to-set as shown in FIG. 4. The orifices 71–73 need not be limited to the rectangular cross-sectional shapes of FIGS. 3 and 4; as shown in FIGS. 5 and 6, respectively, the orifices 71–73 can have triangular or circular (as used herein, the term "circular" is intended to include oval shapes) cross-sectional shapes to optimize effectiveness. The orifices 71–73 are shown in FIGS. 3–6 as being oriented parallel to the longitudinal axis of the fuel nozzle assembly 32. However, this is only for purposes of illustration and is not necessarily the actual orientation. The orifices 71–73 are preferably oriented with or against the swirl of the air flowing through the premix tube 46.

In operation, each fuel nozzle assembly 32 of each combustor 14 functions in a similar fashion. At start-up, diffusion gas fuel will be fed through the diffusion gas passage 61 and the internal channel 74 for discharge via the orifices 71 into the combustion chamber 70 within the liner 38 where it mixes with combustion air. This mixture is ignited by the spark plug 20 and burned in the combustion chamber 70. The diffusion injection mode can also be used for emergency operations. For liquid fuel operation, liquid fuel is fed through the liquid fuel passage 63 and the channel 76 for discharge via the orifices 73. The liquid fuel is atomized by air discharged from the atomizing air passage 62 and the channel 75 via the orifices 72 and burned in the combustion chamber 70. The liquid fuel injection mode is provided mostly as a back-up system to the primary, low $NO_x$ mode of operation.

For low $NO_x$ operation, premix gas fuel is supplied to the premix gas passage 60 for discharge through the injection ports 68 in the radial fuel injectors 66. The premix fuel mixes with air entering the premix tube 46 from the annular space between the combustion liner 38 and the flow sleeve 34 and passing through the swirler 50. The mixture flows into the combustion chamber 70 where it is ignited by the preexisting flame from the diffusion mode of operation. This flow of the fuel-air mixture is referred to herein as the primary flow into the combustion chamber 70.

During premix, low $NO_x$ operation, the passages 61–63 are purged with a flow of air to prevent the ingress of flame gases from the combustion chamber 70. Thus, discrete jets of purge air, directed across the primary flow into the combustion chamber 70, will be emitted from each of the discharge orifices 71–73 in the discharge tip 55. These jets will disrupt or break-up the spanwise vortices shed from the bluff end of the fuel nozzle assembly 32, thereby decreasing combustion instabilities and pressure oscillations. Moreover, the angular injection of purge air will increase the size of the recirculation zone and reduce the adverse effect of purge air on the recirculation zone temperature and flame stability because the air will be well mixed by the shear layer. And when operating in the diffusion and/or liquid fuel modes, the shear layer will produce enhanced mixing of fuel injected through the orifices 71–73 as compared to conventional injection from the end face. The improved mixing will decrease $NO_x$ emissions and increase ignition performance.

The foregoing has described an improved fuel nozzle assembly for gas turbine combustors which extends the operating range of the combustors and reduces fatigue due to pressure oscillations. While specific embodiments of the present invention have been described, it will be apparent to those skilled in the art that various modifications thereto can be made without departing from the spirit and scope of the invention as defined in the appended claims.

What is claimed is:

1. A fuel nozzle assembly comprising:

a substantially cylindrical body having a cylindrical surface, a longitudinal axis and first and second internal passages;

a plurality of fuel injectors extending radially outward from the cylindrical surface of said body, each one of said fuel injectors having at least one injection port in fluid communication with said first passage;

a plurality of discharge orifices formed in the cylindrical surface of said body; and a plurality of channels fluidly connecting said discharge orifices to said second passage, each of said channels forming an acute angle with said longitudinal axis.

2. The fuel nozzle of claim 1 wherein said angle is approximately 45 degrees.

3. The fuel nozzle of claim 1 wherein said body comprises a plurality of concentric tubes and a discharge tip disposed at the forward end of said tubes, said first and second passages being formed between adjacent ones of said tubes and said discharge orifices being formed in said discharge tip.

4. The fuel nozzle of claim 3 wherein said plurality of channels are formed in said discharge tip.

5. The fuel nozzle of claim 1 further comprising a third passage in said body and a second plurality of discharge orifices formed in the cylindrical surface of said body, said second plurality of discharge orifices being in fluid communication with said third passage.

6. The fuel nozzle of claim 1 wherein each one of said discharge orifices is rectangular.

7. The fuel nozzle of claim 1 wherein each one of said discharge orifices is circular.

8. The fuel nozzle of claim 1 wherein each one of said discharge orifices is triangular.

9. A gas turbine apparatus comprising at least one fuel nozzle assembly, said fuel nozzle assembly comprising:

a substantially cylindrical body having a cylindrical surface, a longitudinal axis, a premix gas passage and a diffusion gas passage disposed therein;

a plurality of fuel injectors extending radially outward from the cylindrical surface of said body, each one of said fuel injectors having at least one injection port in fluid communication with said premix gas passage;

a plurality of discharge orifices formed in the cylindrical surface of said body; and a plurality of channels fluidly connecting said discharge orifices to said diffusion gas passage, each of said channels forming an acute angle with said longitudinal axis.

10. The gas turbine apparatus of claim 9 wherein said body comprises a plurality of concentric tubes and a discharge tip disposed at the forward end of said tubes, said premix gas and diffusion gas passages being formed between adjacent ones of said tubes and said discharge orifices being formed in said discharge tip.

11. The gas turbine apparatus of claim 9 wherein said plurality of channels are formed in said discharge tip.

12. The gas turbine apparatus of claim 9 wherein said angle is approximately 45 degrees.

13. The gas turbine apparatus of claim 9 further comprising:

a liquid fuel passage in said body;

a second plurality of discharge orifices formed in the cylindrical surface of said body, said second plurality of discharge orifices being in fluid communication with said liquid fuel passage;

an atomizing air passage in said body; and a third plurality of discharge orifices formed in the cylindrical surface of said body, said third plurality of discharge orifices being in fluid communication with said atomizing air passage.

14. The gas turbine apparatus of claim 9 wherein each one of said discharge orifices is rectangular.

15. The gas turbine apparatus of claim 9 wherein each one of said discharge orifices is circular.

16. The gas turbine apparatus of claim 9 wherein each one of said discharge orifices is triangular.

17. The gas turbine apparatus of claim 9 wherein said discharge orifices are located downstream from said fuel injectors.

18. The gas turbine apparatus of claim 1 wherein each of said channels is angled in a circumferential direction.

19. The gas turbine apparatus of claim 9 wherein each of said channels is angled in a circumferential direction.

* * * * *